US007204258B2

(12) United States Patent
Schmidt

(10) Patent No.: US 7,204,258 B2
(45) Date of Patent: Apr. 17, 2007

(54) METHOD FOR CLEANING AND/OR DISINFECTING THE VACUUM CHANNELS OF A SEALING STATION

(75) Inventor: Herrmann Schmidt, Bad Laasphe (DE)

(73) Assignee: Convenience Food Systems Wallau GmbH & Co. KG, Wallau (DE)

( * ) Notice: Subject to any disclaimer, the term of this patent is extended or adjusted under 35 U.S.C. 154(b) by 0 days.

(21) Appl. No.: 10/495,542

(22) PCT Filed: Oct. 17, 2002

(86) PCT No.: PCT/EP02/11608

§ 371 (c)(1),
(2), (4) Date: Nov. 3, 2004

(87) PCT Pub. No.: WO03/042043

PCT Pub. Date: May 22, 2003

(65) Prior Publication Data

US 2005/0045211 A1 Mar. 3, 2005

(30) Foreign Application Priority Data

Nov. 14, 2001 (DE) ..... 101 55 757

(51) Int. Cl.
*B08B 9/027* (2006.01)

(52) U.S. Cl. ..... 134/22.11; 134/21; 134/22.1

(58) Field of Classification Search ..... 134/22.1, 134/22.11, 21, 25.2; 53/116.7, 167, 432, 53/510

See application file for complete search history.

(56) References Cited

U.S. PATENT DOCUMENTS

| | | | | |
|---|---|---|---|---|
| 4,296,068 | A * | 10/1981 | Hoshino | 422/62 |
| 4,446,674 | A * | 5/1984 | Inada | 53/502 |
| 4,996,824 | A | 3/1991 | Torterotot | 53/167 |
| 6,199,350 | B1 * | 3/2001 | Brechel et al. | 53/510 |
| 6,202,388 | B1 | 3/2001 | Sanfilippo et al. | 53/432 |

FOREIGN PATENT DOCUMENTS

| | | | |
|---|---|---|---|
| DE | 2 357 173 | | 8/1974 |
| DE | 44 22 713 | A1 | 1/1996 |
| DE | 4422713 | * | 1/1996 |
| DE | 197 16 846 | C1 | 11/1998 |
| EP | 0 341 396 | | 3/1989 |
| EP | 1 094 003 | | 4/2001 |
| EP | 1094003 | * | 4/2001 |

* cited by examiner

*Primary Examiner*—Michael Barr
*Assistant Examiner*—Saeed T. Chaudhry
(74) *Attorney, Agent, or Firm*—Perman & Green, LLP

(57) ABSTRACT

The invention relates to a method, whereby a cleaning and disinfecting circuit is established for the vacuum channels of an upper sealing tool (1) and a lower sealing tool (2). In the present case, the vacuum pump (3) is switched off and the connecting line to the sealing station is sealed or disconnected from the flanges at the point (10). The vacuum channels of the upper sealing station (1) are connected to the vacuum channels of the lower sealing tool (2) by means of an adapter (13) in a fluid-tight manner. The fluid circuit is closed by a pump (14), a fluid container (15) and the associated pipes, which are connected to the flanges (11), (12). Said pump (14) pumps a cleaning and disinfecting fluid, in the present case active chlorine, into the vacuum channels of the upper sealing station (1).

6 Claims, 3 Drawing Sheets

METHOD FOR CLEANING AND/OR DISINFECTING THE VACUUM CHANNELS OF A SEALING STATION

This application claims the benefit of the earlier filed International Applicaton No. PCT/EP02/11608, International Filing Date, 17 Oct. 2002, which designated the United States of America, and which international application was published under PCT Article 21 (2) as WO Publication No. WO 03/042043 A1 and which claims priority from German Application No. DE 101 55 757.4, filed 14 Nov. 2001.

BACKGROUND

1. Field

The invention relates to a method for cleaning and/or disinfecting the vacuum channels of a sealing station in which the vacuum channels are separated from the pump and connected to a cleaning and/or disinfecting circuit at regular intervals.

The invention also relates to a cleaning and/or disinfecting circuit, a cleaning adapter and a packaging machine.

2. Brief Description of the Related Developments

Nowadays, increasingly high demands are made on the hygiene of packaging machines, in particular in the foodstuffs field. Consequently, it is necessary to ensure that all parts of the packaging machine which come into direct or indirect contact with the packaged items are cleaned and disinfected at regular intervals.

Publication EP 1 094 003 discloses a device for closing containers filled with packaging items with stopper plugs. The device facilitates the cleaning and disinfection of the evacuation device for the evacuation of the headroom of the container of the filled injection-moulded parts without having to attach additional parts to the evacuation device.

The need for cleaning and disinfection also applies to the vacuum channels in the sealing station which are used to draw the air out of the packaging and, for example, replace it with inert gas. When the air is drawn out, frequently small particles of food are drawn along with it and these are deposited in the vacuum channels and, in particular during the downtime of the packaging machine, encourage germ formation in these vacuum channels.

SUMMARY

Therefore, it was the object of this invention to provide a method for cleaning and/or disinfecting the vacuum channels.

The object is achieved by a method for cleaning and/or disinfecting the vacuum channels of a sealing station whereby the vacuum channels are separated from the pump at regular intervals and connected to a cleaning and/or disinfecting circuit.

It was extremely surprising and unexpected to a person skilled in the art that the method according to the invention enables the production of foodstuffs with far fewer germs and hence a longer shelf life than was possible with machines according to the prior art. The method according to the invention is simple and inexpensive to perform, for example following the daily operation of the machine before its downtime at night.

In a preferred embodiment of the invention, the cleaning circuit comprises a pump and a fluid reservoir. The fluid reservoir contains a cleaning and/or disinfecting fluid, for example active chlorine, which is pumped by the pump through the vacuum channels and runs out of the vacuum channels back into the fluid reservoir. This circuit is maintained until it is ensured that the vacuum channels have been sufficiently cleaned and/or disinfected.

A sealing station generally comprises first and second sealing tools which interact in such a way that a covering film seals a packaging tray. Hereby, a first sealing tool is arranged above the covering film and a second sealing tool below the packaging tray. The second sealing tool is generally vertically adjustable.

In a preferred embodiment of the invention, the first and the second sealing tools are connected independently of each other to a cleaning and/or disinfecting circuit. This embodiment has the advantage that the vacuum channels in the first, upper sealing tool, in which food remnants are frequently deposited, may be cleaned more frequently than the vacuum channels in the second, lower sealing tool.

In another preferred embodiment of the method according to the invention, the sealing station comprises first and second sealing tools which are connected to a cleaning and/or disinfecting circuit and connected to each other by an adapter. The adapter creates a fluid-tight connection between the vacuum channels of the first and second sealing tools so that a fluid circuit can rinse both sealing tools in sequence with the cleaning and/or disinfecting fluid. This embodiment of the method according to the invention is particularly simple to perform and requires only a slight modification of the packaging machine.

The cleaning and/or disinfecting fluid used may be any cleaning and/or disinfecting fluid known to a person skilled in the art capable of cleaning and optionally disinfecting the channels. However, preferably active chlorine is used as the cleaning and/or disinfecting fluid.

Preferably, the cleaning and/or disinfecting circuit is decoupled again following the cleaning and/or disinfection. Germ-free compressed air is then conveyed through the vacuum channels until they have dried, so that no cleaning and/or disinfecting fluid contaminates the food to be packed during the subsequent packaging process.

Another object of the invention is a cleaning and/or disinfecting circuit with a pump, a fluid reservoir and pipes, whereby the pipes may be connected to the vacuum channels in the sealing station of a packaging machine.

The circuit system has the advantage that the vacuum channels in the sealing station are simple and inexpensive to clean. The cleaning and/or disinfecting circuit is simple to attach to the packaging machine.

In a preferred embodiment, the cleaning and/or disinfecting circuit is connected to the packaging machine in a detachable way. This embodiment of the cleaning and/or disinfecting circuit according to the invention has the advantage that a cleaning and/or disinfecting circuit may be used for several packaging machines and that the cleaning and/or disinfecting circuit does not have to be located in the vicinity of the packaging machine during the actual packaging process and hence does not represent a safety and contamination risk for the foodstuffs to be packaged.

Another object of the invention is a cleaning and/or disinfecting adapter for the reversible, fluid-tight connection of the vacuum channels in first and second sealing tools in a sealing station. This cleaning and/or disinfecting adapter enables the first and second sealing tools to be connected together in such a way that both tools may be connected to a cleaning and/or disinfecting fluid circuit so that the cleaning and/or disinfection of the vacuum channels is very simple and quick to perform.

Another object of the invention is a packaging machine, in particular a deep drawing packaging machine with connections for a cleaning and/or disinfecting circuit in the vacuum channels of the sealing station.

In a preferred embodiment, the cleaning and/or disinfecting circuit may be connected in a reversible manner.

BRIEF DESCRIPTION OF THE DRAWINGS

The invention will now be described with reference to FIGS. 1 to 3. These explanations are examples only and do not restrict the general concept of the invention.

DETAILED DESCRIPTION OF THE EMBODIMENTS

Figure 1:
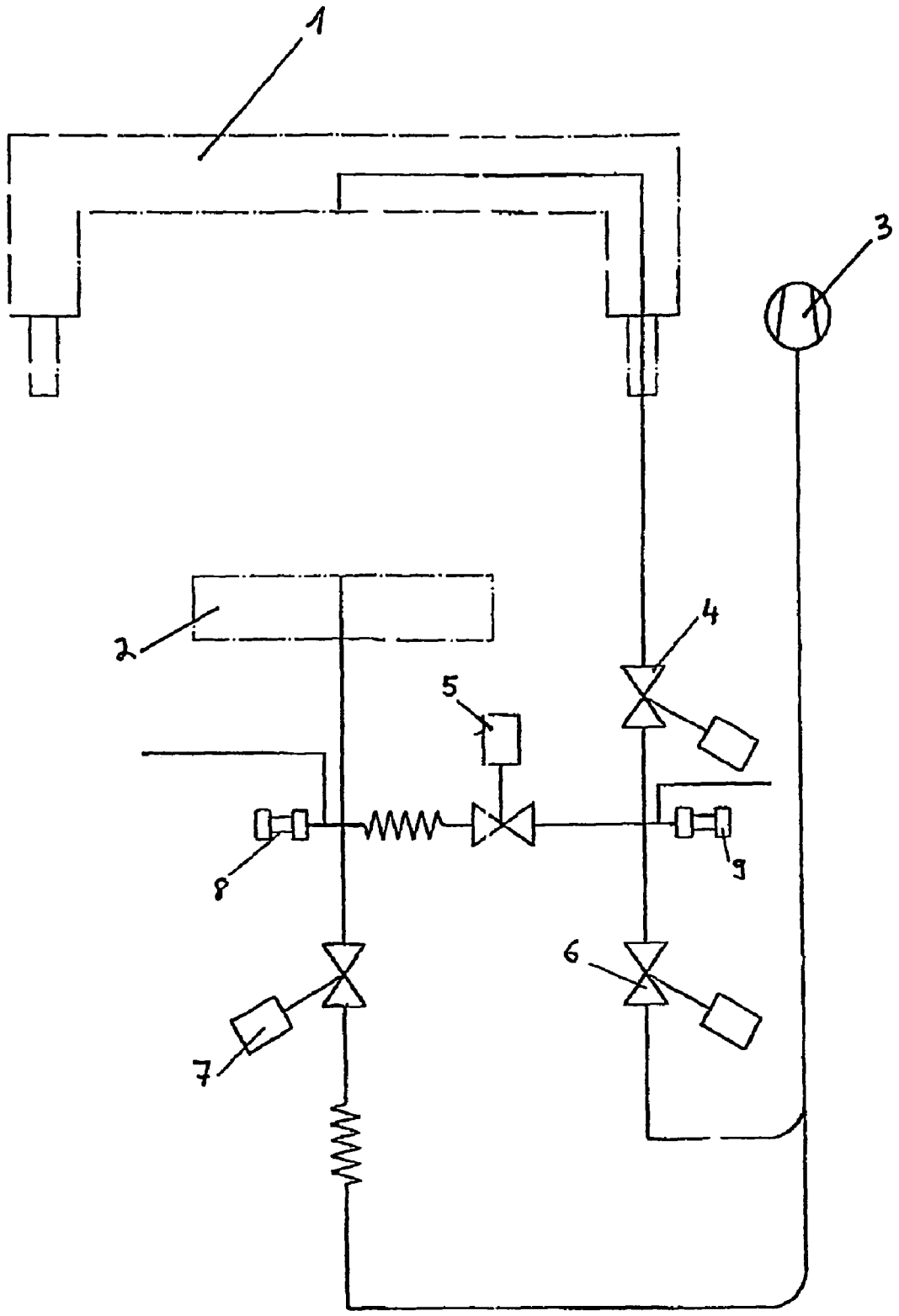
FIG. 1 shows a process diagram for the generation of a vacuum in the first and second sealing tools.

FIG. 1 shows a process diagram for the evacuation of the vacuum channels in a sealing station according to the prior art. The sealing station comprises an upper sealing tool 1 and a lower sealing tool 2. Worked into these sealing tools are channels through which the air may be drawn out of the packaging. It is drawn out via the vacuum pump 3. Valves 4 to 7 distributes underpressure generated by the vacuum pump 3 to the vacuum channels of the upper sealing tool 1 and the vacuum channels of the lower sealing tool 2 in a desired way. When the sealing is completed, the underpressure is relieved via the valves 8 and 9.

Figure 2:
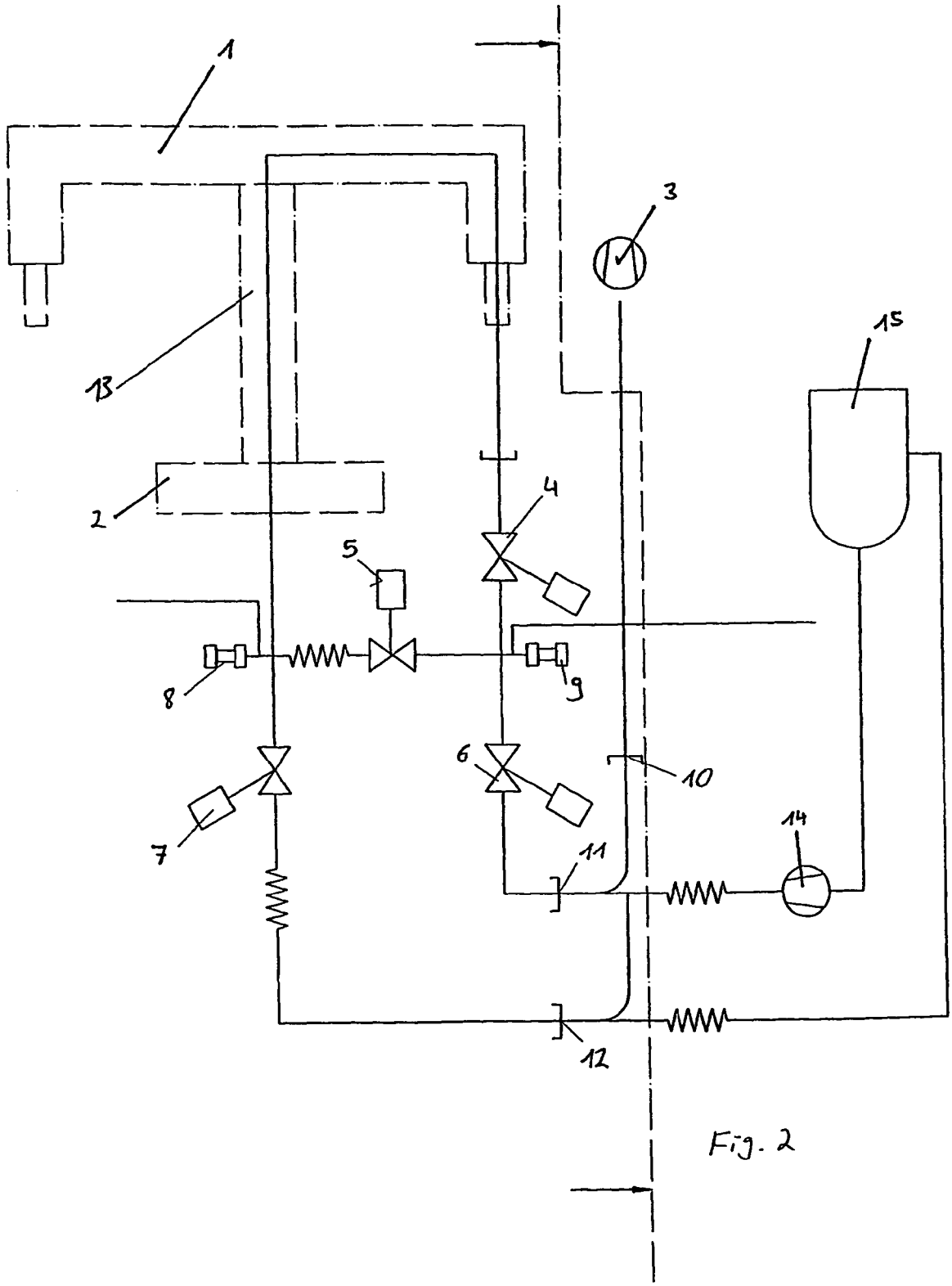
FIG. 2 shows the method according to the invention in which the first and second sealing tools are connected to a cleaning and disinfecting circuit.

FIG. 2 shows a diagram of the method according to the invention in which a cleaning and disinfecting circuit for the vacuum channels of the upper sealing tool 1 and of the lower sealing tool 2 is installed. In this case, the vacuum pump 3 is switched off and the connecting line to the sealing station sealed or disconnected from the flanges at point 10. The vacuum channels in the upper sealing station 1 are connected to the vacuum channels of the lower sealing tool 2 by means of an adapter 13 in a fluid-tight manner. The fluid circuit is closed by a pump 14, a fluid reservoir 15 and the associated pipes which are connected to the flanges 11, 12. The pump 14 pumps a cleaning and disinfecting fluid, in this case active chlorine, into the vacuum channels of the upper sealing tool 1. From there, the fluid runs through the adapter 13 into the vacuum channels of the lower sealing tool 2 from where it is returned to the fluid reservoir 15 in order to participate in the cleaning and/or disinfecting process again. This fluid circuit is maintained until the vacuum channels are sufficiently cleaned and disinfected. For cleaning and/or disinfecting of the valve 5 and the associated pipes, the valve 4 is completely closed so that a fluid circuit is established only by the valves 5, 6 and 7. When the cleaning or disinfecting is completed, the pump 14 and the fluid reservoir 15 are disconnected from the evacuation pipes again and the vacuum pump 3 attached again. In addition, the adapter 13 is removed. Germ-free air is conveyed through the vacuum channels in the sealing tools 1, 2 until they have completely dried so that no cleaning and disinfecting fluid can contaminate the foodstuffs to be packed.

Figure 3:
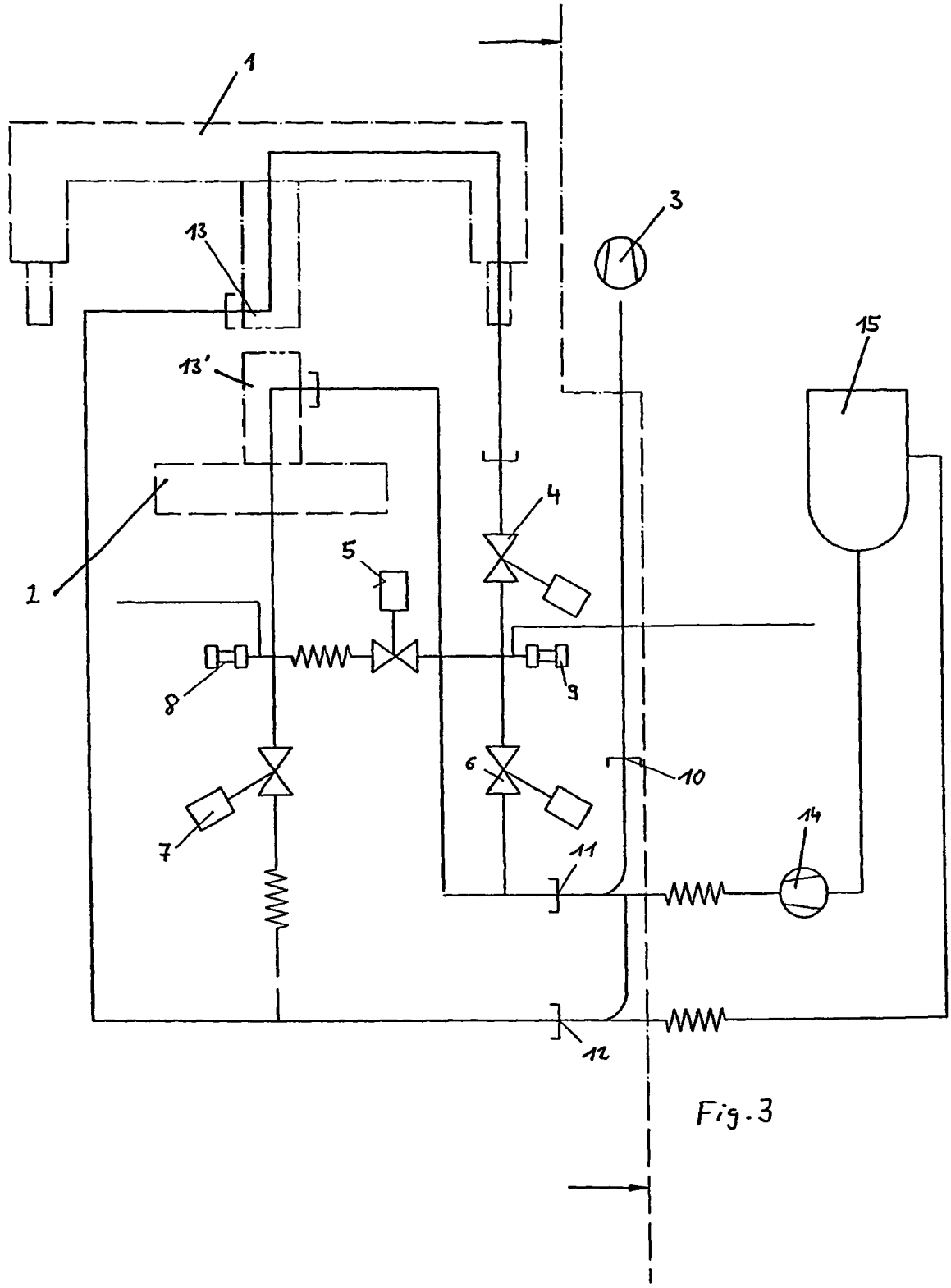
FIG. 3 shows an embodiment of the method according to the invention in which the upper and lower sealing tools are connected independently of each other to a cleaning and disinfecting circuit.

FIG. 3 shows a cleaning and disinfecting circuit for the vacuum channels of the upper sealing tool 1 and the vacuum channels of the lower sealing tool 2. Essentially, the explanations for FIG. 2 apply to this embodiment of the method according to the invention, only in this case the adapters 13, 13' do not establish a connection between the vacuum channels of the upper sealing tool 1 and of the lower sealing tool 2. This enables the vacuum channels in the upper sealing tool to be cleaned independently of the vacuum channels in the lower sealing tool and vice versa. This embodiment of the method is in particular expedient if the vacuum channels in the upper sealing tool are more heavily contaminated than the vacuum channels in the lower sealing tool, as is frequently the case.

Reference Numbers:

1 Upper sealing tool
2 Lower sealing tool
3 Vacuum pump
4–7 Valves to distribute the underpressure generated by the vacuum pump
8–9 Valves to relieve the underpressure
10 Point at which the connecting line from the vacuum pump to the sealing station was sealed or disconnected from the flanges
11–12 Flanges to which the pipes in the cleaning fluid circuit are flanged
13,13' Adapter to connect the vacuum channels in the upper and lower sealing tools
14 Cleaning fluid circuit pump
15 Cleaning fluid reservoir

The invention claimed is:

1. Method for cleaning and/or disinfecting vacuum channels of a sealing station of a deep-drawing packaging machine, the vacuum channels running through first and second sealing tools of the sealing station, the method comprising:

separating the vacuum channels in the first and second sealing tools from a vacuum pump and connecting the vacuum channels to a cleaning and/or disinfecting circuit at regular time intervals;

connecting the vacuum channels in the first and second sealing tools to each other by an adapter;

circulating a cleaning and/or disinfecting fluid through the circuit, the vacuum channels and the adapter; and decoupling the cleaning and/or disinfecting circuit after the cleaning and/or disinfection.

2. Method according to claim 1, wherein the cleaning and/or disinfecting circuit comprises a pump and a cleaning and/or disinfecting fluid reservoir.

3. Method according to claim 1, wherein active chlorine is used as the cleaning and/or disinfecting fluid.

4. Method according to claim 1, wherein after the cleaning and/or disinfecting circuit is decoupled the vacuum channels are dried by conveying germ-free compressed air through the vacuum channels.

5. Cleaning and/or disinfecting circuit comprising:

a pump for circulating a cleaning and/or disinfecting fluid through the circuit;

a fluid reservoir for the cleaning and/or disinfecting fluid;

pipes for leading the cleaning and/or disinfecting fluid, the pipes connecting the fluid reservoir and the pump to vacuum channels in a sealing station of a deep-drawing packaging machine, the vacuum channels running through first and second sealing tools of the sealing station, the pipes further being detachable; and a cleaning and/or disinfecting adapter, which is connected to the vacuum channels in both the first and second sealing tools to provide a detachable, fluid-tight connection between the vacuum channels in the first and second sealing tools of the sealing station.

6. A deep-drawing packaging machine having connections for attachment to a cleaning and/or disinfecting adapter of a cleaning and/or disinfecting circuit, the cleaning and or disinfecting circuit comprising:

a pump for circulating a cleaning and/or disinfecting fluid through the circuit;

a fluid reservoir for the cleaning and/or disinfecting fluid;

pipes for leading the cleaning and/or disinfecting fluid, the pipes connecting the fluid reservoir and the pump to vacuum channels in a sealing station of the deep-drawing packaging machine, the vacuum channels running through first and second sealing tools of the sealing station, the pipes further being detachable; and the cleaning and/or disinfecting adapter is connected to the vacuum channels in both the first and second sealing tools to provide a detachable, fluid tight connection between the vacuum channels in the first and second sealing tool of the sealing station.

* * * * *